US008441350B2

(12) United States Patent
Candelore

(10) Patent No.: US 8,441,350 B2
(45) Date of Patent: May 14, 2013

(54) APPARATUS AND METHOD FOR OPERATION OF A DISPLAY DEVICE TO PROVIDE A HOME SECURITY ALARM

(75) Inventor: Brant Candelore, San Diego, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 899 days.

(21) Appl. No.: 12/557,231

(22) Filed: Sep. 10, 2009

(65) Prior Publication Data

US 2011/0057796 A1 Mar. 10, 2011

(51) Int. Cl.
*G08B 13/00* (2006.01)

(52) U.S. Cl.
USPC ..... 340/565; 340/521; 340/541; 340/573.1; 348/152; 348/155

(58) Field of Classification Search ..... 340/565, 340/521, 531, 541, 545.3, 573.1; 348/143, 348/148, 152, 155; 379/40, 42, 43, 44
See application file for complete search history.

(56) References Cited

U.S. PATENT DOCUMENTS

| | | | | |
|---|---|---|---|---|
| 5,705,982 | A * | 1/1998 | Faltings | 340/541 |
| 6,762,686 | B1 | 7/2004 | Tabe | |
| 2002/0015094 | A1* | 2/2002 | Kuwano et al. | 348/143 |
| 2007/0182543 | A1* | 8/2007 | Luo | 340/521 |
| 2009/0167862 | A1* | 7/2009 | Jentoft et al. | 348/143 |

FOREIGN PATENT DOCUMENTS

| | | |
|---|---|---|
| GB | 2182791 | 5/1987 |
| GB | 2408166 | 5/2005 |

OTHER PUBLICATIONS

Pramod et al., *Intelligent Intrusion Detection System(In2DS) Using Wireless Sensor Networks*, http://ieeexplore.ieee.org/search/freesrchabstract.jsp?arnumber=4919343&isnumber=4919225&punumber=4907391&k2dockey=4919343@ieeecnfs&query=(((tv+or+television)+and+(ir+or+infrared+or+infrared)+and+sensor)+and+alarm)%3Cin%3Emetadata&pos=2 (website); Mar. 2009.

Nam, Ihngeun; "Digital Home Solution & Business Strategy of KOCOM"; Presentation given at the Home Network Global Summit Mar. 5-6, 2007 in Seoul, Korea; 23 pages.

Kocom Co. Ltd; 2006/2007's Kocom Product Catalog; 2006; 24 Pages (pp. 1-8 original document, pp. 9-24 zoomed in version).

* cited by examiner

*Primary Examiner* — Hung T. Nguyen
(74) *Attorney, Agent, or Firm* — Fitch, Even, Tabin & Flannery LLP

(57) ABSTRACT

An apparatus and method are provided for operation of a display device to provide a home security alarm. In one embodiment, a method includes receiving a user alarm activation command by the display device; initiating a detection mode, by the display device, based on the user command; and detecting, by a sensor of the display device, at least one of a presence and motion within a target area of the display device. The process may also include outputting an alarm signal, by the display device, based on detecting the at least one of a presence and motion in the target area.

21 Claims, 5 Drawing Sheets

APPARATUS AND METHOD FOR OPERATION OF A DISPLAY DEVICE TO PROVIDE A HOME SECURITY ALARM

FIELD OF THE INVENTION

The present invention relates generally to display devices, and more particularly to a display device configured to provide a home security alarm.

BACKGROUND OF THE INVENTION

Televisions have traditionally been configured to display broadcast media. In many households, a television may be located in a living room for viewing by one or more members of the household. Many users additionally utilize display devices for viewing recorded media, as a home theater and for gaming. As a result, the display device is often surrounded by one or more high value devices, such as a set-top box, game console, media player (e.g., high definition video disc), multimedia computer, etc. For some users, the cost of owning a display device itself may be substantial. Thus, there is a desire to provide security for items in a consumer household around the display device.

Conventional alarm systems typically secure a household through a combination of detecting opening and/or closing of one or more doors or windows and motion detectors which detect movement in open spaces of a household. These systems typically require wiring and/or setup of one or more sensors and detectors throughout a home for installation. Unfortunately, the cost required for installation and service fees of these conventional alarm systems may be prohibitive to many consumers. Additionally, many consumers rent their home or apartment from a landlord. As such, it is not convenient for a renter to pay for the installation and wiring of conventional alarm systems in a rented household if the landlord is not willing to pay for it. In homes where alarm systems are installed, security capabilities may not provide adequate coverage as the sensors of these conventional systems are generally located at an entrance, window or hallway. Further, conventional home security systems may not adequately protect devices located within a household.

There has been a lot of attention recently directed to reducing the power consumption of television devices. Some techniques include using LED backlights instead of fluorescent backlights in LCD televisions. However, these techniques do not address when a viewer leaves the room.

Thus, there exists a desire to provide security for items in consumer households and power reduction in a display device.

BRIEF SUMMARY OF THE INVENTION

Disclosed and claimed herein are methods and apparatus for operation of a display device to provide home security alarm. In one embodiment, a method includes receiving a user command by the display device, initiating a detection mode by the display device based on the user command, and detecting by a sensor of the display device at least one of a presence and motion within a target area of the display device. The method further includes outputting an alarm signal, by the display device, based on detecting at least one of a presence and motion in the target area.

Other aspects, features, and techniques of the invention will be apparent to one skilled in the relevant art in view of the following detailed description of the invention.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

Figure 1:
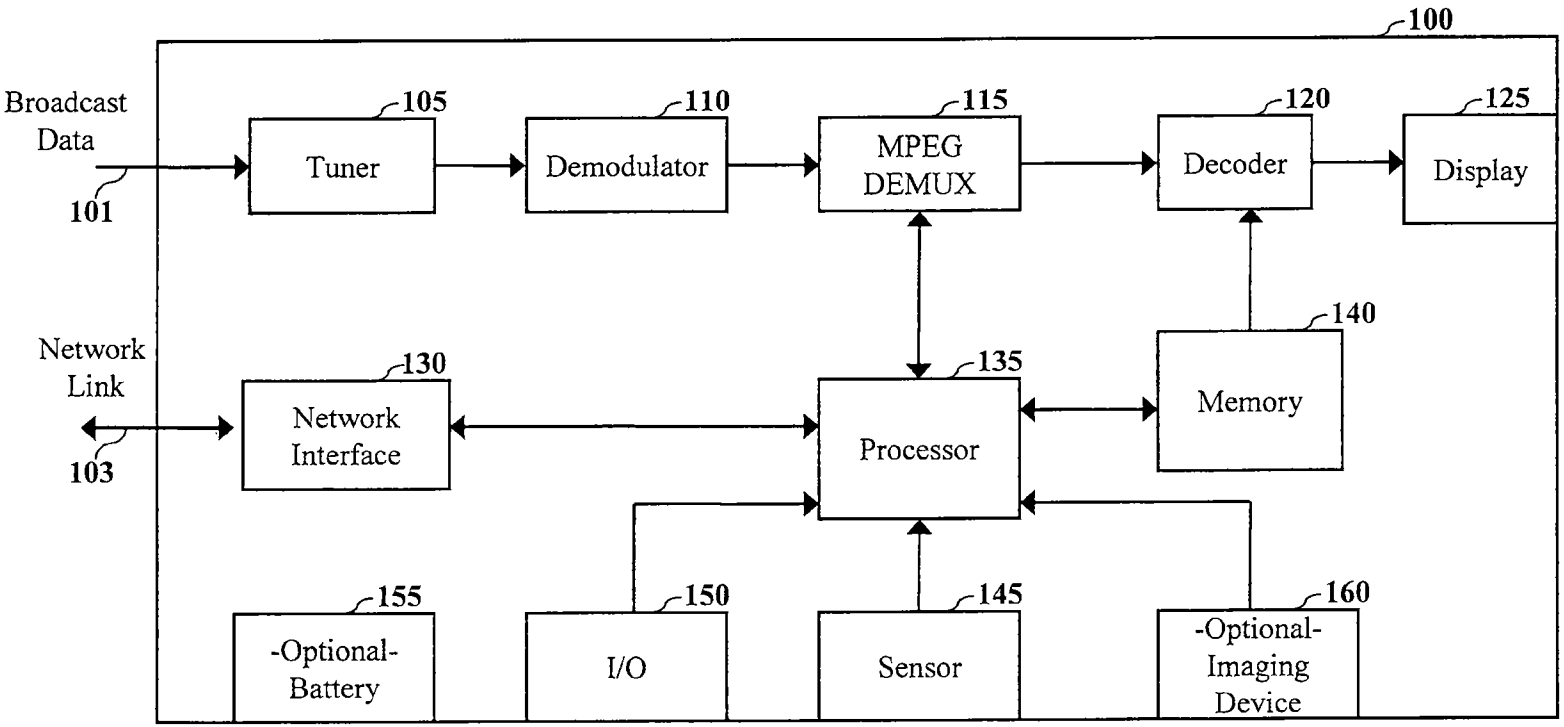
FIG. 1 depicts a simplified block diagram of a display device according to one embodiment.

One aspect of the present invention relates to operation of a display device. In one embodiment, a process is provided for operation of the display device to provide a home security alarm. The process may be initiated by the processor of the display device receiving a user command to initiate a detection mode of the display device. A sensor of the display device may detect at least one of the presence and motion within an area in front of the display device. When a sensor of the display device detects at least one of a presence and motion within an area in front of the display device, the display device can output a warning sound. In exemplary embodiment, the warning sound can last between 30 to 60 seconds. During this period of time, the consumer may be required to input a passcode using a remote control of the display device. In another embodiment, if the proper code is not input and the warning period (e.g., 30 to 60 seconds) elapses, then a loud alarm signal may be output from the display device.

In one embodiment, a display device is provided which includes a sensor configured to detect at least one of a presence and motion within a target area of the display device. A processor of the display device may be configured to output one or more commands based on detection of the presence and/or motion. The display device may further include an imaging device (e.g. a camera) to capture one or more images and/or video data when at least one of the presence and motion is detected.

As used herein, the terms “a” or “an” shall mean one or more than one. The term “plurality” shall mean two or more than two. The term “another” is defined as a second or more. The terms “including” and/or “having” are open ended (e.g., comprising). The term “or” as used herein is to be interpreted as inclusive or meaning any one or any combination. Therefore, “A, B or C” means “any of the following: A; B; C; A and B; A and C; B and C; A, B and C”. An exception to this definition will occur only when a combination of elements, functions, steps or acts are in some way inherently mutually exclusive.

Reference throughout this document to “one embodiment,” “certain embodiments,” “an embodiment,” or similar term means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner on one or more embodiments without limitation.

In accordance with the practices of persons skilled in the art of computer programming, the invention is described below with reference to operations that are performed by a computer system or a like electronic system. Such operations are sometimes referred to as being computer-executed. It will be appreciated that operations that are symbolically represented include the manipulation by a processor, such as a central processing unit, of electrical signals representing data bits and the maintenance of data bits at memory locations, such as in system memory, as well as other processing of signals. The memory locations where data bits are maintained are physical locations that have particular electrical, magnetic, optical, or organic properties corresponding to the data bits.

When implemented in software, the elements of the invention are essentially the code segments to perform the necessary tasks. The code segments can be stored in a processor readable medium, which may include any medium that can store or transfer information. Examples of the processor readable mediums include an electronic circuit, a semiconductor memory device, a read-only memory (ROM), a flash memory or other non-volatile memory, a floppy diskette, a CD-ROM, an optical disk, a hard disk, a fiber optic medium, a radio frequency (RF) link, etc.

Exemplary Embodiments

Referring now to the Figures, FIG. 1 depicts a simplified block diagram of display device according to one embodiment of the invention. According to one embodiment of the invention, a display device may be configured to operate as a display device (i.e., television, monitor, etc.) and to provide a home security alarm. Advantages of the present invention over conventional alarm systems include the ability to provide a stand alone alarm system. The alarm system may be situated where high value items may be located. Similarly, the display device may also be configured to interoperate with a home security system in another embodiment. According to one embodiment, display device 100 may be configured to display one or more programs based on received broadcast data, shown as 101. As shown, display device 100 includes tuner 105, demodulator 110, moving pictures experts group (MPEG) de-multiplexer (DEMUX) 115, decoder 120 and processor 135 for output of one or more broadcast programs on display 125. In one embodiment, display device 100 may relate to a television. Although display device 100 is described as having the aforementioned elements, it should also be appreciated that the device may include additional and/or different elements for display of one or more programs.

As further shown, display device includes memory 140 which relates to one of a RAM and flash memory. Memory 140 may be configured to store one or more operating instructions for processor 135. According to another embodiment, memory 140 may include recorded media for output by display device 100. In yet another embodiment, memory 140 may include audio and/or image data for output by the security system.

According to another embodiment, display device 100 includes sensor 145 for detecting a presence and/or motion within a target area of display device 100. The target area of the display device may be based on sensor 145. Exemplary range values include a target area of up to 15 feet from display device 100. However, it should be equally appreciated that other target area ranges may be employed. In one exemplary embodiment, sensor 145 relates to an infrared sensor. As will be described in more detail with respect to FIG. 2, sensor 145 may be housed in the bezel or housing of display device to detect a presence and/or motion within close proximity of the display device. Based on one or more signals output by sensor 145, processor 135 may be configured to output an alarm signal. For example, an IR sensor may have varying output based on movement and/or the presence of a person in the target area. In that fashion, the display device 100 may function as a home security system. Display device 100 may include network interface 130 for communication via network link 103 with one or more networks, such as a home security provider network, communication network, etc. In that fashion, the home security provider may be alerted by the detection sensor 145. According to another embodiment, network interface 130 may allow for communication between the display device 100 and a personal communication device of one or more residents of the household. In certain embodiments, a user can program and/or set alarm functions of the display device using a personal communication device (e.g., mobile phone, computer, etc.) via network interface 130.

According to another embodiment, output of sensor 145 may be utilized by processor 135 to provide a reduced power operating mode (e.g., "eco" mode). As will be discussed in more detail below with reference to FIG. 4, the processor may initiate an eco mode when a presence and/or motion have not been detected for a predetermined period of time. In another embodiment, a reduced power mode of display device 100 may be associated with a sleep function and/or timer function of the display device. According to another embodiment, the reduced power mode may allow for functions to be performed by display device 100 while providing the appearance that the device is not currently operational. For example, in a reduced power mode, display device may be configured to monitor one or more signals generated by sensor 145 while appearing to be in an "off" state to a user. However, because display device 100 may be configured to operate with a minimal power draw from a power source in the reduced power mode, the display device minimizes the power required for operation. According to another embodiment, battery 155 may be charged by display device while "on" and then provide power for sensor 145 when display device 100 is in the off state or reduced power state. In certain embodiments, display device 100 may include optional battery 155 to allow for back up power in the event of a power outage. For example, an intruder may hear the warning sound, and could unplug display device 100. With battery 155, however, the alarm could continue to operate for a period of time. In that fashion, display device 100 may allow for uninterrupted home security.

Input/Output (I/O) interface 150 of display device 100 may be configured to receive one or more input commands from a user. In one embodiment I/O interface 150 may receive one or more signals from a remote control as will be described in more detail with respect to FIG. 2 below. Accordingly, I/O interface 150 may be used to set an alarm and control operation of display device 100.

According to another embodiment, display device 100 may include optional imaging device 160 which may be configured to detect one or more images when a presence and/or motion is detected by senor 145 of the display device. Display device 100 can be configured to transmit one or more images via network interface 130 as one or more of an email message, multi-media text message, and message in general. In that fashion, the user may be alerted of a false alarm or an actual presence in the home. Imaging device 160 may relate to one or more of a charge coupled device (CCD), and complimentary metal oxide semiconductor (CMOS) image sensor.

Image data collected by imaging device 160 may be stored in memory 140. Alternatively or in combination, imaging device 160 maybe configured to detect one or more pictures which may be uploaded to a website using network interface 130.

According to another embodiment, it may be possible to use facial recognition in lieu of having to input a passcode. By way of example, upon entering the household and hearing the warning sound from the display device, the household member could position him or herself in front of imaging device 160. A facial image of the household member could be compared against a database of household members. The database could be stored within display device 100, in a network accessible location, offsite, etc. In that fashion, display device 100 may be configured to provide passive monitoring of the target area. It may also be appreciated that imaging device 160 may be employed to record a video message to be provided as an output in the alarm mode. In a further embodiment, imaging device 160 may be employed as a sensor by display device 100, wherein a presence and/or motion in the target area may be detected based on a change in pixel data of detected images.

Although FIG. 1 describes a display device, it should equally be appreciated that the invention may be directed to other devices.

Figure 2:
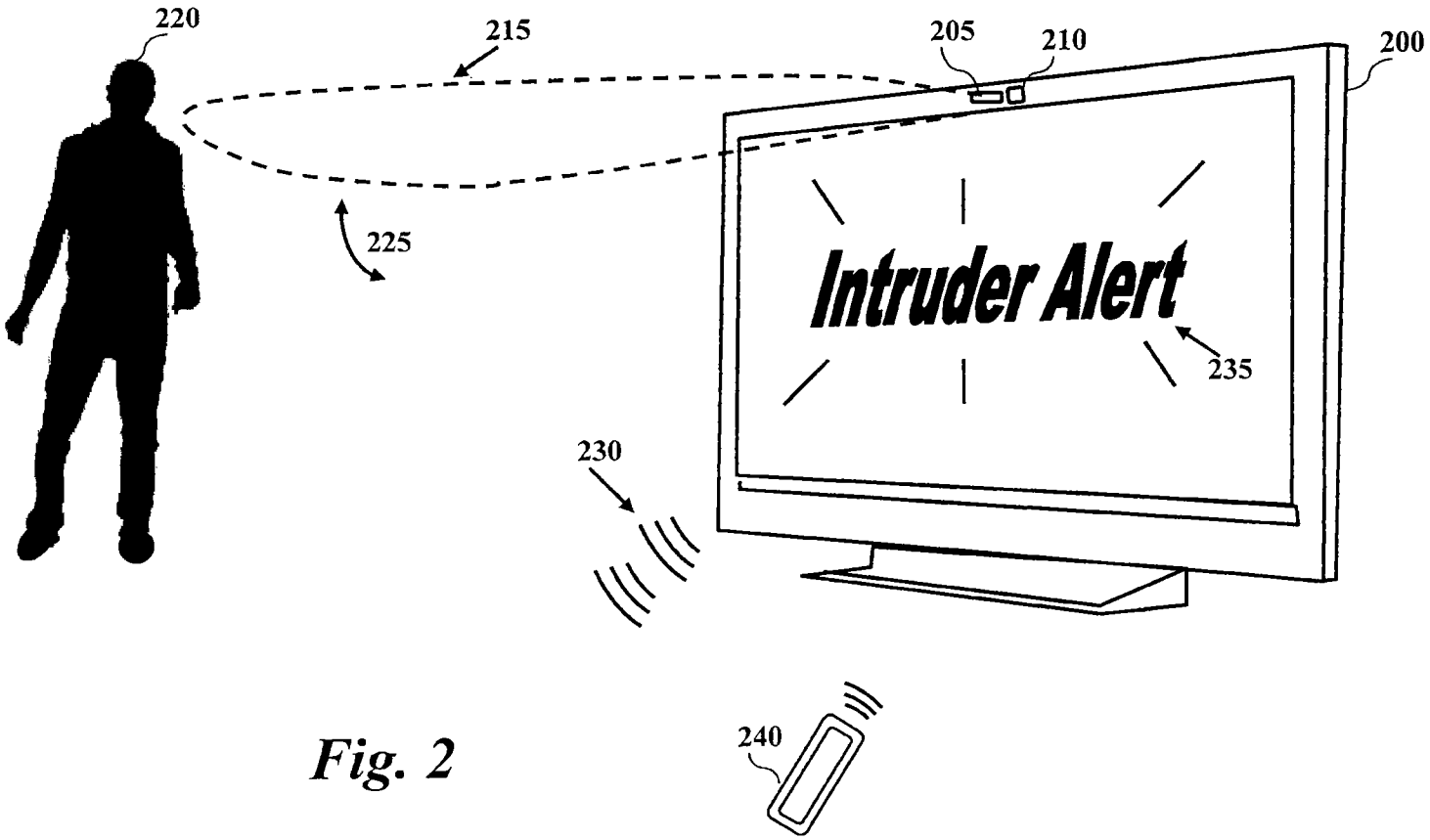
FIG. 2 depicts a graphical representation of a display device according to one or more embodiments.

Referring now to FIG. 2, a graphical representation of the display device of FIG. 1 is depicted according to one or more embodiments of the invention. Display device 200 (e.g., display device 100) includes sensor 205 (e.g., sensor 145) and imaging device 210 (e.g., image sensor 160). In one embodiment, sensor 205 may be configured to detect one or more objects, such as the presence of person 220 in a detection area, shown as 215, situated anterior to the display device 200. Display device 200 may be configured to allow a user to select and set a range of detection area 215 and/or may allow for adjusting detection area as shown by direction 225. Display device 200 may further provide a graphical user interface for selection and/or setting of one or more of an alarm mode and a reduced power mode.

In an alarm mode of display device 200, detection of a presence, such as person 220, may activate the home security alarm of the display device. In one embodiment, in a standalone mode, the detection of a presence, such as person 220, by the display device in an alarm mode may first activate a warning signal and after a while activate an audible alarm, shown as 230, and/or displayed message 235. The warning signal may relate to a loud beeping noise which may last for thirty to sixty seconds. In another embodiment, the warning signal may relate to a prerecorded message. Displayed message 235 is shown as a text message which may be programmed by a user. However, in another embodiment, display device may output a prerecorded video message. If display device 100 is networked with a household alarm system (not shown), the display device may become another sensor to the household alarm system. Household alarm systems will typically have a delay and output a warning signal upon entering from a door (not shown). In this situation, if the display device 100 detects a presence without entry through a door, then the alarm is immediately activated.

Alternatively or in combination, detection of person 220 may initiate transmission to a security system provider and/or resident of the home via a network interface (e.g., network interface 130) of display device 200. Based on detection of person 220, imaging device 210 may detect one or more images. In one embodiment, imagining device 210 may be configured to collect image data associated with the detection area 215. According to another embodiment, imaging device 210 may be configured to detect a panoramic image of the area the display device is located. In an alternative embodiment, imaging device 210 may be configured to identify one or more faces. Accordingly, the face of an intruder (e.g., person 220) may be compared against a database (not shown) of household member faces. The database can be one of a local database and networked database.

According to another embodiment, activation, and deactivation of the alarm mode and/or reduced power mode of display device 200 may be transmitted to the display device by remote transmitter 240.

In a reduced power mode, display device 200 may detect the presence and/or movement of a person 220 in detection area 215. When movement and/or the presence is not sensed for a predetermined period of time, such as ten minutes, display device 200 may cease displaying content, in effect shutting down display device 200. In one embodiment, a user can set the predetermined period of time for detection of motion and/or a presence in the reduced power mode. It should also be appreciated that other predetermined time periods may be employed. In certain embodiments, display device can enter a hibernating or sleep mode and periodically check for a user presence. Based on detection of a presence and/or motion, display device 200 may then resume normal display operation.

Figure 3:
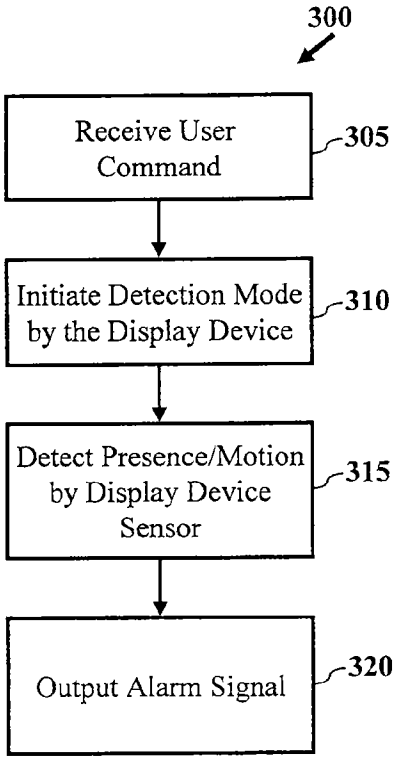
FIG. 3 a process for providing a home security alarm by a display device according to one or more embodiments.

Referring now to FIG. 3, a process is depicted for operation of the display device of FIG. 1 according to one embodiment. Process 300 may be initiated by the display device (e.g., display device 100) receiving a user command to initiate a detection mode 305. A processor (e.g., processor 135) of the display device initiates the detection mode at block 310. In one embodiment, the display device can enter an alarm mode based on the user command. The alarm mode may be entered by the user providing a code and/or activation of one or more terminals of the display device or a remote control of the display device. In certain embodiments, in a standalone mode, the display device may then wait a predetermined time to allow for a user to arm the display device and clear the target area. A presence and/or movement may be detected as shown in block 310 due to movement of a person in front of the display device. When a person is detected in the alarm mode, the display device can output an alarm signal at block 315. As discussed herein, the alarm signal may relate to at least one of an initial warning signal, an audible alarm 320, displayed image(s), and one or more communications sent by a network interface of the display device.

Figure 4:
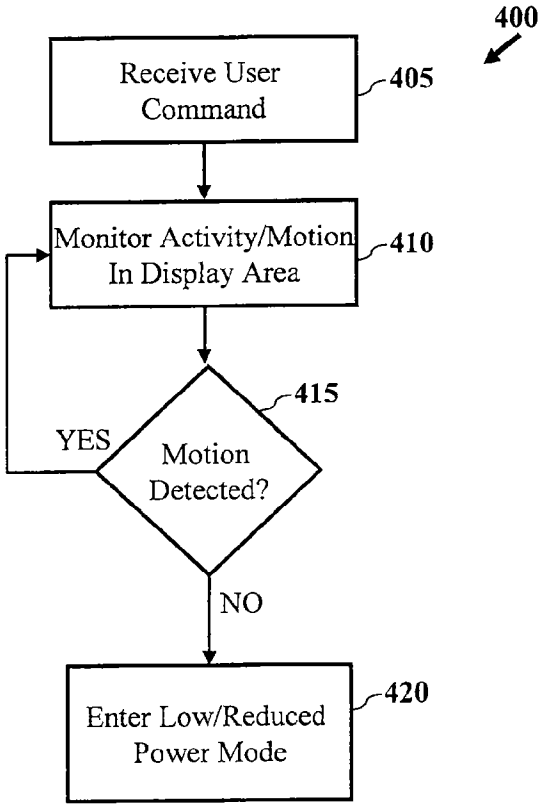
FIG. 4 depicts a process for reducing power consumption of a display device according to one or more embodiments.

Referring now to FIG. 4, a process is depicted for operation of the display device of FIG. 1 according to another embodiment. Process 400 may be initiated by the display device (e.g., display device 100) receiving a user command to initiate a detection mode at block 405. A processor (e.g., processor 145) of the display device monitors activity and/or motion in a region anterior to the display device at block 410. In one embodiment, after a certain amount of time, the display device can enter a reduced power mode to reduce power and/or disconnect power to the display of the display device when a user is no longer present. In that fashion, the display device may reduce the power needed for operation and provide a higher energy rating (e.g., eco friendly display device). At decision block 415, the display device checks if motion has been detected within a predetermined period of time. When motion has been detected ("YES" path out of decision block 410) the display device continues to monitor activity and/or motion in a detection area at block 410. When motion has not been detected ("NO" path out of decision block 410) the display device enters a low/reduced power mode at block 420.

Figure 5:
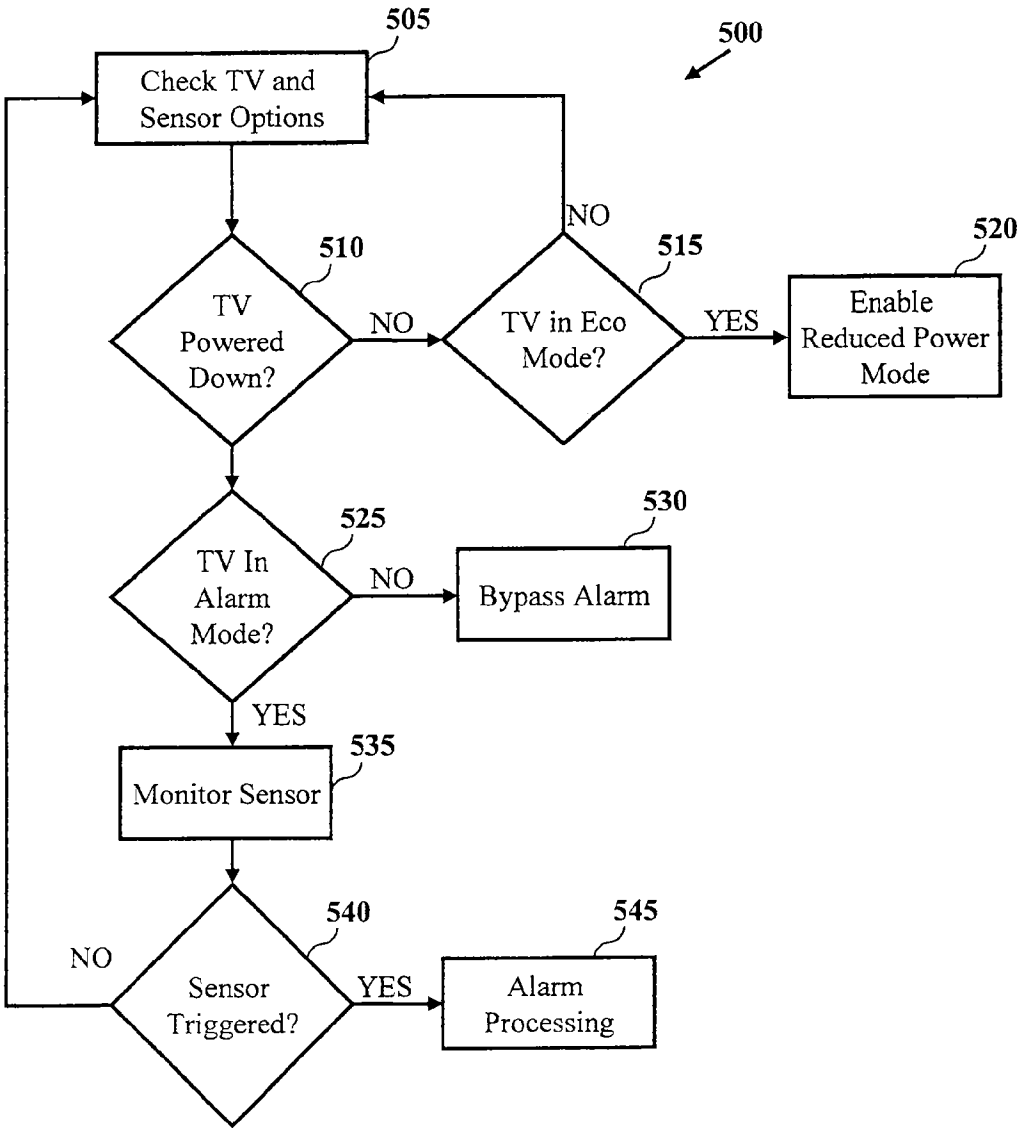
FIG. 5 depicts a process for operation of a display device system according to one or more embodiments.

Referring now to FIG. 5, a process is depicted for operation of the display device of FIG. 1 according to another embodiment. Process 500 may be performed by a display device to allow for a home security mode and low power mode based on one or more user settings. In one embodiment, the display device relates to a television and is referenced to as a TV in FIG. 5. Process 500 may be initiated by a processor of the display device (e.g., display device 100) checking options of the display device and sensor at block 505. For example, the processor may determine if the display device is operating as a stand alone device or in conjunction with a home network security system. Similarly, the system may determine if the user has input any settings for a reduced power mode and/or alarm mode. Process 500 may proceed to determine if the display device is powered down at block 510. When the display device is not powered down ("NO" path out of decision block 510) the display device then determines if the display device is in an eco mode (i.e., reduced power mode) at decision block 515. When the display device is not in an eco mode ("NO" path out of decision block 515) the display device continues to check the display device and sensor options at block 505. When the display device is in an eco mode, ("YES" path out of decision block 515) the display device enables a reduced power mode at block 520 as described above with reference to FIG. 4.

Returning to decision block 510, when the display device is powered down ("YES" path out of decision block 510) the processor of the display device then determines if the display device is set in an alarm mode at decision block 525. When the display device is not in an alarm mode ("NO" path out of decision block 525) the display device then bypasses the alarm at block 530. When the display device is in an alarm mode ("YES" path out of decision block 525) the display device monitors the sensor output at block 535. At decision block 540, a processor of the display device monitors sensor output to determine if a presence and/or motion triggers the sensor. When the sensor is not triggered ("NO" path out of decision block 540) checking options of the display device and sensor at block 505. When the sensor is triggered ("YES" path out of decision block 540) the display device processes the alarm signal at block 545 as discussed above with reference to FIG. 3. In one embodiment, the alarm signal may include outputting a recorded message by a user of the display device at block 545.

Figure 6:
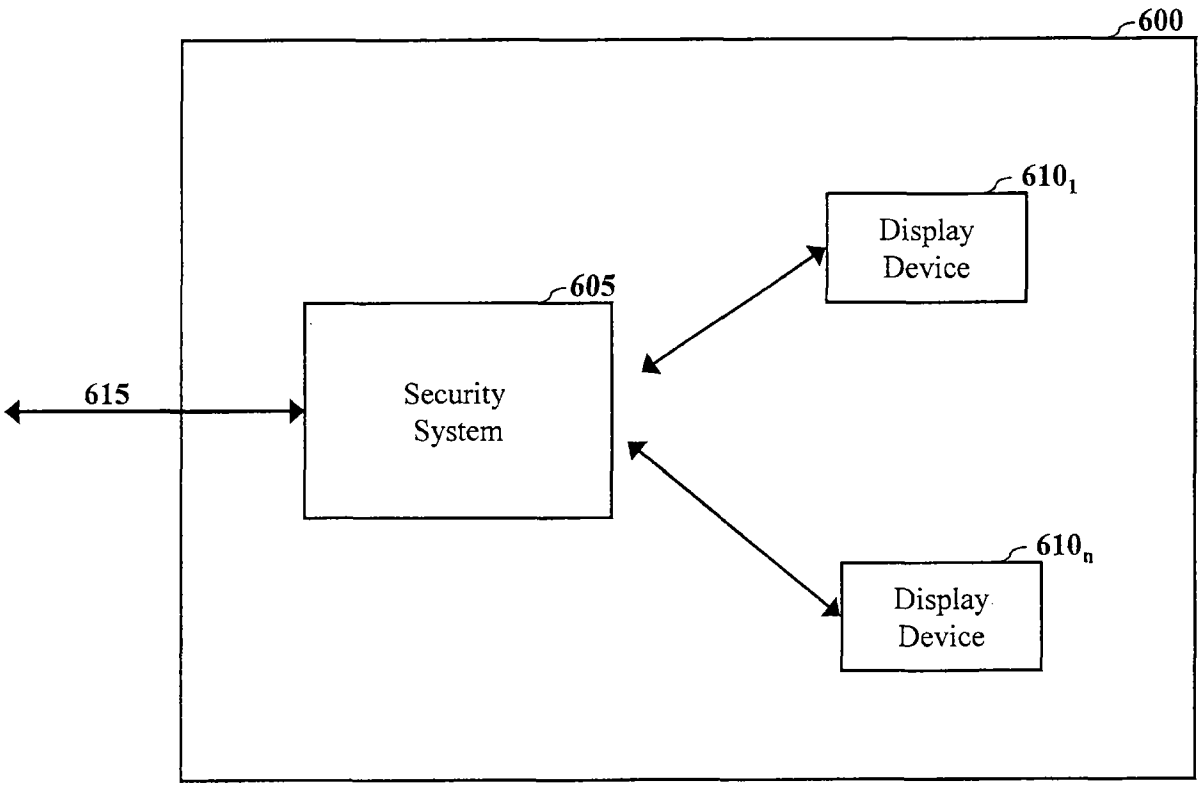
FIG. 6 depicts a simplified block diagram of home security system according to one embodiment.

Referring now to FIG. 6, a graphical representation is shown of a system having one or more of the display devices of FIG. 1 according to one embodiment. As shown in FIG. 6, a location 600, such as a residence or place of business, may include a security system 605 and at least one of display device (e.g., display device 100). Display devices $\mathbf{610}_{1\text{-}n}$ may be coupled to the control panel of the security system 605 by one of a wired and wireless connection. According to one embodiment, the alarm modes of display devices $\mathbf{610}_{1\text{-}n}$ may be set by a user using home security system 605. Once the display devices $\mathbf{610}_{1\text{-}n}$ are in an alarm mode, activation of an alarm of one or more of display devices $\mathbf{610}_{1\text{-}n}$ may be detected by security system 605 which may be configured to transmit one or more signals to a call center and/or processing center of a security provider. In that fashion, one or more of display devices $\mathbf{610}_{1\text{-}n}$ can interoperate with security system 605. According to another embodiment, activation of one of the display devices $\mathbf{610}_{1\text{-}n}$ may activate at least one other display device within location 600. As can bee seen, one advantage of employing display devices may be to increase the detection area of an alarm system. When entering the household, if one of devices $\mathbf{610}_{1\text{-}n}$ is configured to include and imaging device (e.g., imaging device 160), the imaging device can be used to for facial recognition and to avoid input of a passcode into the security system 605.

While this invention has been particularly shown and described with references to exemplary embodiments thereof, it will be understood by those skilled in the art that various changes in form and details may be made therein without departing from the scope of the invention encompassed by the appended claims.

What is claimed is:

1. A method for operation of a display device to provide a home security alarm, the method comprising the acts of:

receiving a user command by the display device;

initiating a detection mode, by the display device, based on the user command;

detecting, by a sensor of the display device, at least one of a presence and motion within a target area of the display device; and outputting an alarm signal, by a processor of the display device, based on detecting the at least one of a presence and motion in the target area.

2. The method of claim 1, wherein the command is received from a home security system in communication with the display device.

3. The method of claim 1, wherein the at least one of presence and motion within the target area is detected by infrared (IR) detection.

4. The method of claim 1, wherein the at least one of presence and motion within the target area is detected by a change of pixels as determined by an imaging device of the display device.

5. The method of claim 1, wherein the alarm signal relates to at least one of an audible alarm output by the display device and a visual display for a predetermined period of time.

6. The method of claim 1, wherein the alarm signal relates to at least one of an email, multi-media message, message to a mobile communication device, message to a home security provider and network communication message in general.

7. The method of claim 1, further comprising capturing an image of the target area, by a imaging device of the display device, upon detection of at least one of the presence and motion within the target area of the display device.

8. The method of claim 1, further comprising entering a low power mode when that at least one of the presence and motion within the target area is not detected for a predetermined amount of time.

9. A display device comprising:

a sensor configured to detect at least one of a presence and motion within a target area of the display device; and a processor coupled to the sensor, the processor configured to receive a user command;

initiate a detection mode;

receive sensor output indicating that at least one of a presence and motion within the target area of the display device;

output an alarm signal based on detection of the at least one of a presence and motion.

10. The display device of claim 9, further comprising an interface configured to receive the user command, wherein the user command is received from at least one of a remote control and a home security system in communication with the display device.

11. The display device of claim 9, wherein the sensor is configured to detect the at least one of presence and motion within the target area by infrared (IR) detection.

12. The display device of claim 9, wherein the sensor is configured to detect the at least one of presence and motion within the target area by a change of pixels.

13. The display device of claim 9, wherein the alarm signal relates to at least one of an audible alarm output by the display device and a visual display for a predetermined period of time.

14. The display device of claim 9, wherein the alarm signal relates to at least one of an email, multi-media message, message to a mobile communication device, message to a home security provider and network communication message in general.

15. The display device of claim 9, further comprising an imaging device configured to capture an image of the target area upon detection of at least one of the presence and motion within a target area of the display device.

16. The display device of claim 9, further comprising entering a low power mode when the at least one of the presence and motion within the target area of the display device is not detected for a predetermined amount of time.

17. A method for operation of a display device to provide a home security alarm, the method comprising the acts of:

receiving a user command by the display device;

initiating a detection mode, by the display device, based on the user command;

detecting, by a sensor of the display device, at least one of a presence and motion within a target area of the display device; and entering a low power mode, as activated by a processor of the display device, when at least one of the presence and motion within the target area of the display device is not detected for a predetermined amount of time.

18. The method of claim 17, wherein the command is received from at least one of a user interface and remote control of the display device.

19. The method of claim 17, wherein the at least one of presence and motion within the target area is detected by infrared (IR) detection.

20. The method of claim 17, wherein the at least one of presence and motion within the target area is detected by a change of pixels as determined by an imaging device of the display device.

21. The method of claim 17, further comprising outputting an alarm signal, by the display device, based on detecting the at least one of a presence and motion in the target area.

* * * * *